United States Patent [19]

Ootsuka et al.

[11] Patent Number: 4,670,050

[45] Date of Patent: Jun. 2, 1987

[54] METHOD OF TREATING MOLTEN ALUMINUM BY REMOVING HYDROGEN GAS AND NONMETALLIC INCLUSIONS THEREFROM

[75] Inventors: Ryotatsu Ootsuka, Osaka; Shigemi Tanimoto; Kazuo Toyoda, both of Izumi, all of Japan

[73] Assignee: Showa Aluminum Corporation, Sakai, Japan

[21] Appl. No.: 809,818

[22] Filed: Dec. 17, 1985

[51] Int. Cl.[4] ..... C22B 21/06

[52] U.S. Cl. ..... 75/68 R; 75/93 AC

[58] Field of Search ..... 75/68 R, 93 AC

[56] References Cited

U.S. PATENT DOCUMENTS 1,921,998 8/1933 Bonsack ..... 75/68 R
3,198,625 8/1965 Stroup ..... 75/68 R
3,972,709 8/1976 Chia et al. ..... 75/93 AC
4,402,741 9/1983 Pollet et al. ..... 75/93 E

FOREIGN PATENT DOCUMENTS 1067071 1/1984 U.S.S.R. ..... 75/93 AC

*Primary Examiner*—Melvyn J. Andrews
*Attorney, Agent, or Firm*—Armstrong, Nikaido, Marmelstein Kubovcik

[57] ABSTRACT

Hydrogen gas and nonmetallic inclusions are removed from molten aluminum by a method comprising applying over the surface of molten aluminum in a container a mixture of at least one compound selected from the group consisting of boron oxides, boric acids and boric acid compounds and a flux comprising a halgen salt, introducing a treating gas into the molten aluminum, and removing the hydrogen gas-containing treating gas and nonmetallic inclusions rising to the surface of the molten aluminum.

5 Claims, 7 Drawing Figures

METHOD OF TREATING MOLTEN ALUMINUM BY REMOVING HYDROGEN GAS AND NONMETALLIC INCLUSIONS THEREFROM

BACKGROUND OF THE INVENTION

The present invention relates to a method of treating molten aluminum by removing hydrogen gas and nonmetallic inclusions therefrom.

The term "aluminum" as used herein and in the claims includes pure aluminum and all aluminum alloys. Further the term "inert gas" is used herein as including argon gas, helium gas, krypton gas and xenon gas in the Periodic Table, and also including nitrogen gas which is inert to aluminum.

Molten aluminum before casting contains dissolved hydrogen gas, aluminum and magnesium oxides and like nonmetallic inclusions as undesirable impurities. Hydrogen gas and nonmetallic inclusions, when contained in molten aluminum, could create defects in the ingot obtained from the melt and the product prepared from the ingot. Accordingly, hydrogen gas and nonmetallic inclusions must be removed from molten aluminum.

Hydrogen gas and nonmetallic inclusions are removed from molten aluminum conventionally by introducing into the molten aluminum an inert gas, halogen gas such as chlorine gas, or halogen compound gas such as Freon in the form of bubbles. However, the water contained in the atmosphere (in an amount of up to about 30 mg/liter during summer or up to about 5 mg/liter during winter in Osaka, Japan) poses the problem that aluminum reacts with the water in the atmosphere at the surface of molten aluminum ($2Al+3H_2O \rightarrow Al_2O_3+3H_2$), permitting the resulting hydrogen to penetrate into the molten aluminum. The surface of molten aluminum at rest is usually covered with a compact film of aluminum oxide which prevents the aluminum from reacting with the water in the atmosphere. Nevertheless, when an inert gas, chlorine gas or like treating gas is introduced in the form of bubbles into molten aluminum, the bubbles rising to the surface of the melt disturb the surface and break the aluminum oxide film covering the surface to expose the aluminum melt surface to the atmosphere. Consequently, the water in the atmosphere reacts with the aluminum to evolve hydrogen gas, which penetrates into the molten aluminum before a fresh oxide film is formed at the broken portion.

To solve the problem, it has been proposed to introduce the treating gas into molten aluminum as placed in a sealed container, with its interior space above the melt surface filled with an inert gas to a pressure higher than atmospheric pressure (U.S. Pat. No. 3,870,511). However, this method requires an expensive device for holding the container sealed, while even if the container is of sealed structure, some air inevitably ingresses into the container through an inlet for molten aluminum and through a minute clearance between the closure and the container main body. We have substantiated by experiments that even if the interior atmosphere above the melt surface has a water content of as low as about 0.5 mg/liter due to the ingress of some air, the water reacts with the molten aluminum to evolve hydrogen, with the result that it is impossible to achieve a satisfactory hydrogen gas removal efficiency, i.e., to reduce the amount of hydrogen gas in the melt to about 0.10 cc per 100 g of the melt.

Moreover, it is difficult for the conventional methods to effectively remove hydrogen gas from molten aluminum having a high purity of at least 99.9 wt. %.

SUMMARY OF THE INVENTION

An object of the present invention is to provide a method of removing hydrogen gas and nonmetallic inclusions by introducing a treating gas into molten aluminum, the method being adapted to inhibit the reaction between the aluminum and the water in the atmosphere above the surface of the molten aluminum to achieve an improved hydrogen gas removal efficiency.

Another object of the present invention is to provide a method which does not require a treating container of sealed construction for containing molten aluminum and which can therefore be practiced by an inexpensive apparatus.

The method of the present invention for treating molten aluminum by removing hydrogen gas and nonmetallic inclusions from the molten aluminum comprises applying over the surface of molten aluminum in a treating container a mixture of at least one compound selected from the group consisting of boron oxides, boric acids and boric acid compounds, and a flux comprising a halogen salt, introducing a treating gas into the molten aluminum, and removing the hydrogen gas-containing treating gas and nonmetallic inclusions rising to the surface of the melt.

Even if the atmosphere above the molten aluminum within the treating container contains water, this method greatly inhibits the reaction between the water and the aluminum to achieve an improved hydrogen removal efficiency. Moreover, the method does not require the expensive device which is necessary for holding the treating container sealed.

When the mixture of at least one compound selected from the group consisting of boron oxides, boric acids and boric acid compounds, and a flux comprising a halogen salt is applied over the surface of molten aluminum, the mixture prevents the reaction of the aluminum with the water contained in the atmosphere above the surface of the melt to preclude evolution of hydrogen gas, consequently preventing penetration of hydrogen gas into the aluminum melt from the atmosphere. Although the principle of this phenomenon still remains to be clarified in detail, the effect will presumably be attributable to the following. When the mixture is scattered over the surface of the molten aluminum, the flux acts to melt the compound, which in turn covers the entire surface. Some chemical reaction consequently occurs to form over the melt surface a film which prevents the reaction between the molten aluminum and the water in the atmosphere.

Examples of useful boron oxides are diboron trioxide, diboron dioxide, tetraboron trioxide, tetraboron pentaoxide and the like. Exemplary of useful boric acids are orthoboric acid, metabolic acid, tetrabolic acid and the like. Examples of useful boric acid compounds are sodium metaborate, sodium tetraborate, sodium pentaborate, sodium hexaborate, sodium octaborate, sodium diborate, lithium metaborate, lithium tetraborate, lithium pentaborate and the like. Examples of useful halogen salts are potassium chloride, potassium fluoride, sodium chloride and the like. Such halogen salts are usable in admixture.

Examples of useful treating gases to be introduced into molten aluminum are those heretofore used for removing hydrogen gas and nonmetallic inclusions from molten metals. They include inert gases, halogen gases such as chlorine gas, and halogen compound gases such as Freon.

The hydrogen in the molten aluminum diffuses through the bubbles of the treating gas and is entrained in the gas bubbles when the bubbles rise through the melt to the melt surface and is released to the atmosphere. The nonmetallic inclusions in the aluminum melt are carried by the treating gas bubbles to the dross layer on the melt surface. The hydrogen-containing treating gas released to the atmosphere and the dross containing the nonmetallic inclusions and floating on the melt surface are removed by a suitable known method. The nonmetallic inclusion removal efficiency attained by the method of the invention is comparable to that achieved by conventional methods.

Hydrogen gas can be removed from molten aluminum of high purity more efficiently by the present method than by the conventional methods.

The present invention will be described below in greater detail with reference to the accompanying drawings.

DESCRIPTION OF THE PREFERRED EMBODIMENTS

Figure 1:
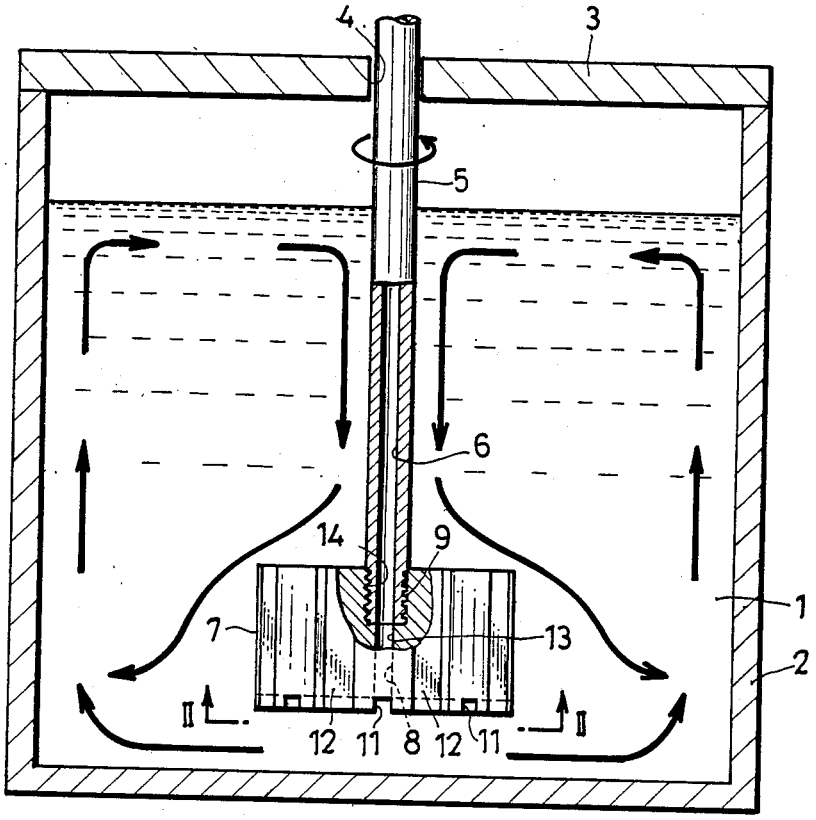
FIG. 1 is a view showing a first embodiment of apparatus for practicing the present method, the view being partly broken away and showing a treating container in section.
Figure 3:
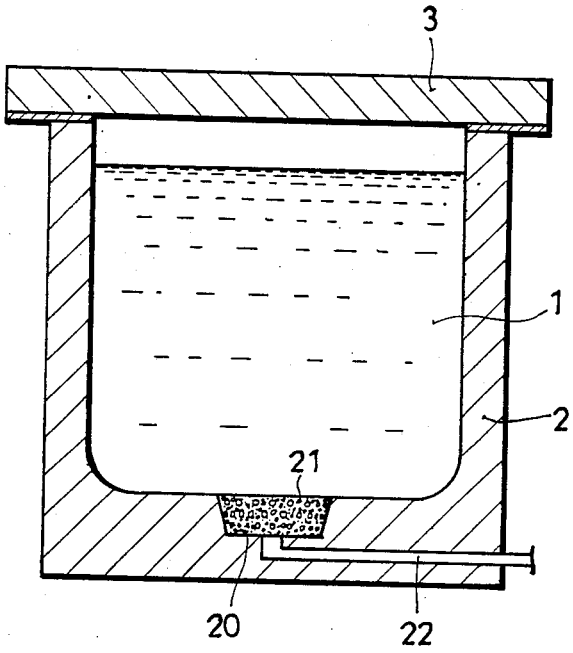
FIG. 3 is a view in vertical section showing a second embodiment of apparatus for practicing the present method.

In FIGS. 1 and 3, like parts are designated by like reference numerals.

Figure 2:
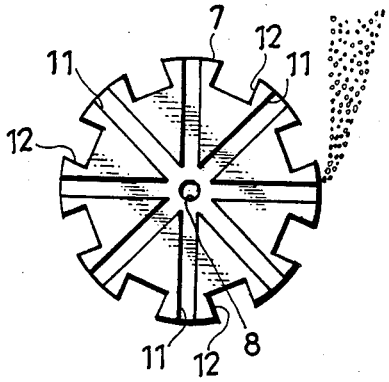
FIG. 2 is a view showing the embodiment as it is seen in the direction of arrows II—II in FIG. 1.

With reference to FIGS. 1 and 2 showing a first embodiment of apparatus for use in practicing the method of the invention for treating molten aluminum, the molten aluminum 1 to be treated and containing hydrogen gas and nonmetallic inclusions is placed in a hollow cylindrical treating container 2 having a bottom, with the surface of the melt 1 positioned slightly below the upper end of the container 2. The container 2 has at its upper end an opening which is closed with a closure 3 having a central hole 4. Provided within the container 2 is a treating gas diffuser comprising a vertical rotary shaft 5 having a gas channel 6 extending axially therethrough and a bubble dividing-diffusing rotor 7 in the form of a disk and fixed to the lower end of the shaft 5. The rotor 7 has at its bottom a gas discharge outlet 8 communicating with the gas channel 6. The shaft 5 extends upward through the hole 4 and is rotated by unillustrated known drive means disposed above the container 2. The gas channel 6 within the shaft 5 is in communication with an unillustrated known gas feeder. The lower end of the shaft 5 is positioned in the vicinity of the bottom of the container 2. The lower end of the shaft 2 is externally threaded as at 9. The rotor 7 has flat bottom and top surfaces and a peripheral surface. The rotor 7 is formed in its bottom surface with a plurality of radial grooves 11 extending from the gas discharge outlet 8 to the bottom periphery and each having an open end at the periphery. Between the open ends of each two adjacent grooves 11, a vertical groove 12 is formed in the peripheral surface of the rotor 7. The vertical groove 12 has an upper end which is open at the top surface of the rotor 7 and a lower end which is open at the bottom surface thereof. A bore 13 extends vertically through the rotor 7 at its center. Approximately upper half of the bored portion 13 is internally threaded as at 14. The externally threaded shaft end 9 is screwed in the internally threaded portion 14, whereby the rotor 7 is fixed to the shaft 5. The lower end of the bore 13 provides the gas discharge outlet 8.

A mixture of at least one compound selected from the group consisting of boron oxides, boric acids and boric acid compounds and a flux comprising at least one halogen salt is scattered over the surface of the molten aluminum 1 within the container 2 of the above apparatus. The compound selected from the group consisting of boron oxides, boric acids and boric acid compounds is applied to the molten aluminum surface preferably in an mount of at least $1.28\times10^{-3}$ g/cm$^2$ calculated as boron, since if the amount of boron is less than $1.28\times10^{-3}$ g/cm$^2$, the effect to be produced by the application of the compound would be insufficient. More preferably, the amount is at least $8\times10^{-3}$ g/cm$^2$. Although it is desirable to use a larger amount of the compound, the amount is limited in view of cost.

After the application of the mixture to the surface of the molten aluminum 1, a treating gas is supplied to the channel 6 from the gas feeder while rotating the shaft 5 about its own axis by the drive means. The gas flows from the lower end of the channel 6 into the bore 13 and is forced out from the bottom of the rotor 7 via the outlet 8. The gas enters the grooves 11, flows through the grooves 11 toward the periphery of the rotor, strikes the edges of the periphery defining the open ends of the grooves 11 and is released into the molten aluminum in the form of minute bubbles. The released minute bubbles are diffused throughout the entire body of the melt in the container 2 as indicated by arrows in FIG. 1 by the melt flowing in the centrifugal direction while being revolved in the same direction as the direction of rotation of the rotor 7, by virtue of the agitating effect of the vertical grooves 12.

With reference to FIG. 3 showing a second embodiment of apparatus for use in practicing the method of treating molten aluminum according to the invention, a cavity 20 is centrally formed in the inner surface of the bottom wall of a treating container 2. A porous body 21 of ceramics for releasing a treating gas in the form of bubbles is intimately fitted in the cavity 20. A treating gas supply pipe 22 extending horizontally through the bottom wall of the container 2 has one end which is open at the bottom of the cavity 21 and the other end which is open and positioned outside the container 2. The outer end of the gas supply pipe 22 is connected to an unillustrated known gas feeder by an unillustrated pipe.

A mixture of at least one compound selected from the group consisting of boron oxides, boric acids and boric acid compounds, and a flux comprising a halogen salt is sprinkled over the surface of molten aluminum 1 in the container 2 of the above apparatus. For the same reason as given above, the amount of the compound to be applied to the surface of the molten aluminum is at least $1.28\times10^{-3}$ g/cm$^2$, preferably at least $8\times10^{-3}$ g/cm$^2$, calculated as boron. After the mixture has been applied over the surface of the melt 1, the treating gas is supplied to the pipe 22 from the gas feeder. The gas is injected into the cavity 20 from the open inner end of the pipe 22 and released in the form of minute bubbles into the melt 1 from the pores of the porous body 21.

EXAMPLE 1

Figure 4:
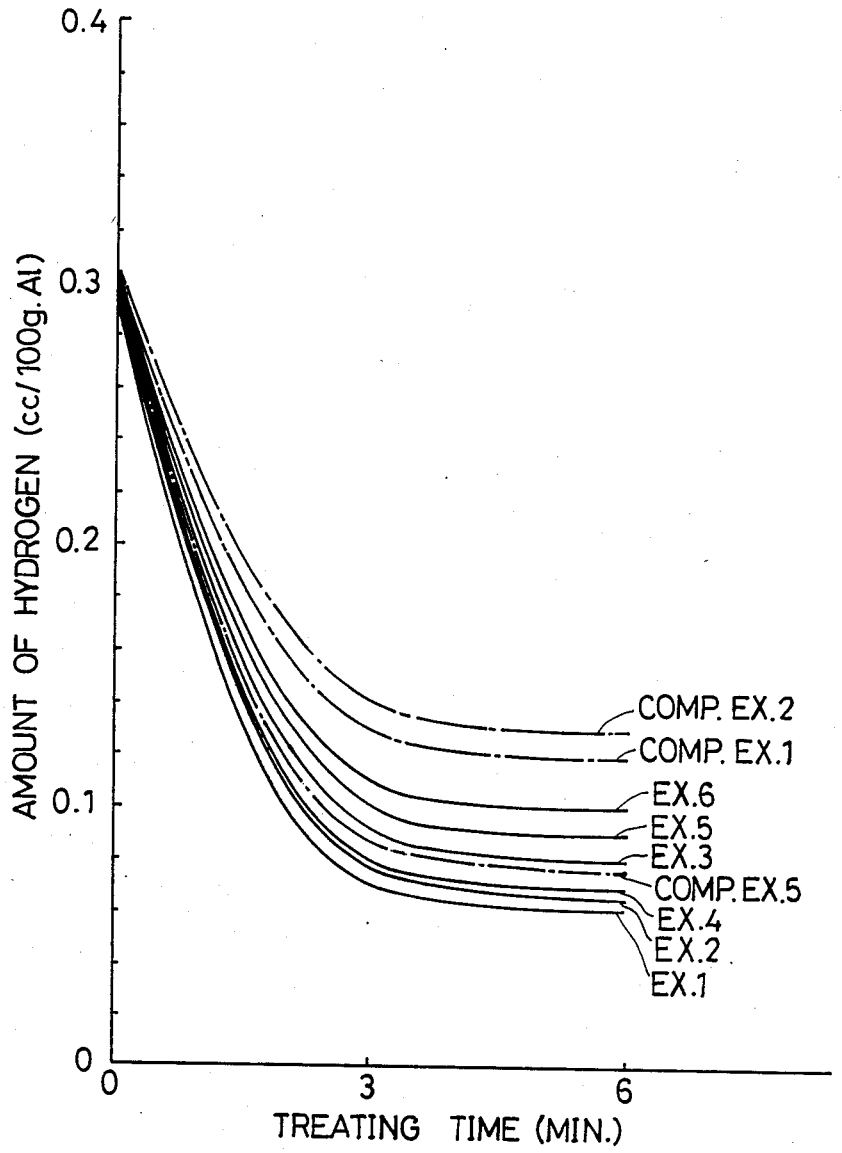
FIG. 4 is a graph showing the relationship between the hydrogen gas removal treating time and the amount of hydrogen gas in the treated molten aluminum, as determined by Examples 1 to 6 and Comparative Examples 1, 2 and 5.

The apparatus shown in FIGS. 1 and 2 was used. Molten A6063 (300 kg) was placed into the container 2, 500 mm in inside diameter, and maintained at 710° C. The surface area of the melt 1 within the container 2 was 1962.5 cm$^2$. The atmosphere within the container 2 above the surface of the melt 1 was found to contain 18 mg/liter of water. A mixture of 60 g of $B_2O_3$ 151.2., g of KCl and 88.8 g of KF was sprinkled over the surface of the molten aluminum 1. The amount of boron applied to the surface of the melt 1 was $9.49\times10^{-3}$ g/cm$^2$. Ar gas was thereafter introduced into the melt 1 at a rate of 20 liters/min from the gas feeder via the channel 6 and the outlet 8 of the rotor 7 while rotating the rotor 7 at 650 r.p.m. To check the melt 1 for hydrogen gas removal efficiency, the amount of hydrogen gas in the melt was measured by the TELEGAS method. Thus, the relationship between the hydrogen gas removal treating time and the amount of hydrogen gas in the treated aluminum melt was determined. The result is shown in FIG. 4.

EXAMPLE 2

Molten aluminum 1 was treated under the same conditions and in the same manner as in Example 1 except that A3003 was used in place of A6063. The relationship between the treating time and the hydrogen gas content of the resulting melt was determined similarly. FIG. 4 shows the result.

EXAMPLE 3

Molten aluminum 1 was treated under the same conditions and in the same manner as in Example 1 except that A1100 was used in place of A6063 to determine the relationship between the treating time and the hydrogen gas content of the resulting melt. FIG. 4 shows the result.

EXAMPLE 4

Molten aluminum 1 was treated under the same conditions and in the same manner as in Example 1 except that before the introduction of Ar gas into the melt 1, a mixture of 52 g of $B_2O_3$, 156.3 g of KCl and 91.7 g of KF was sprinkled over the surface of the melt in an amount of $8.23\times10^{-3}$ g/cm$^2$ calculated as boron. The relationship between the treating time and the hydrogen gas content of the resulting melt was similarly determined. FIG. 4 shows the result.

EXAMPLE 5

Molten aluminum 1 was treated under the same conditions and in the same manner as in Example 1 except that before the introduction of Ar gas into the melt 1, a mixture of 38 g of $B_2O_3$, 165 g of KCl and 97 g of KF was sprinkled over the surface of the melt in an amount of $6.0\times10^{-3}$ g/cm$^2$ calculated as boron. The relation between the treating time and the hydrogen gas content of the resulting melt was determined. FIG. 4 shows the result.

EXAMPLE 6

Molten aluminum 1 was treated under the same conditions and in the same manner as in Example 1 except that before the introduction of Ar gas into the melt 1, a mixture of 8.1 g of $B_2O_3$, 183.9 g of KCl and 108 g of KF was sprinkled over the surface of the melt in an amount of $1.28\times10^{-3}$ g/cm$^2$ calculated as boron. The relation between the treating time and the hydrogen gas content of the resulting melt was determined FIG. 4 shows the result.

EXAMPLE 7

Figure 5:
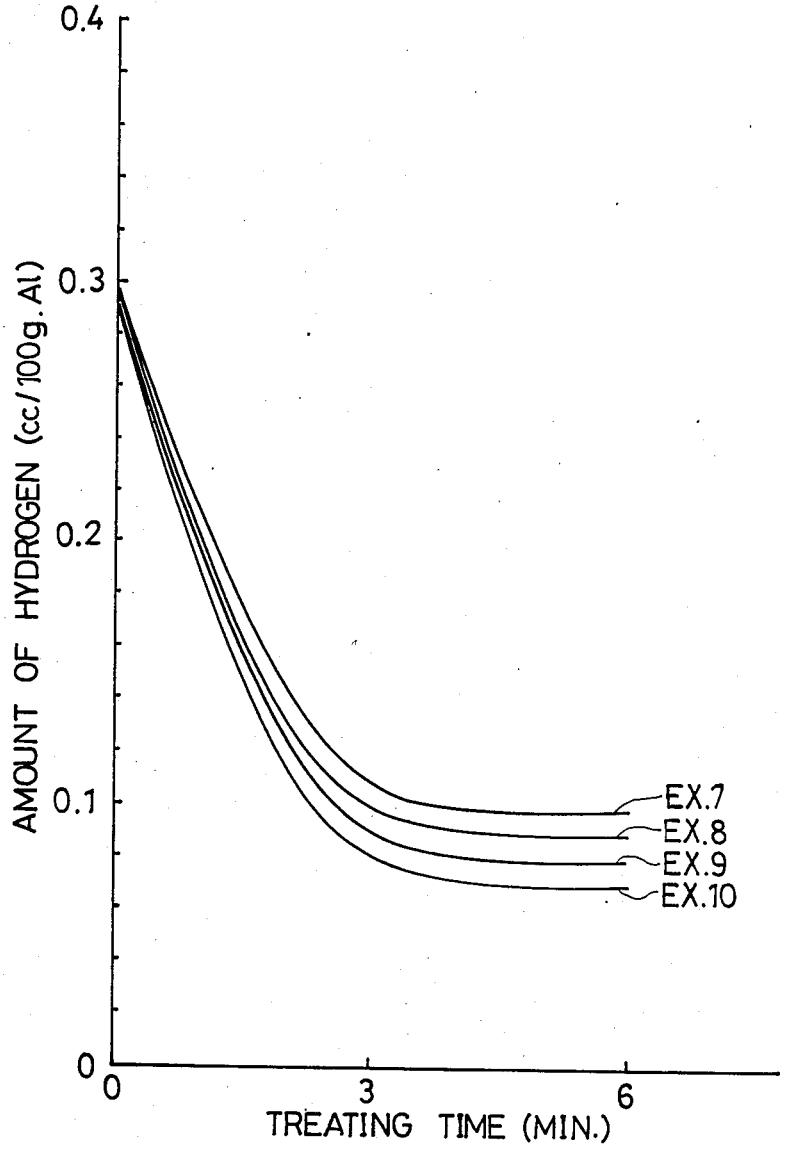
FIG. 5 is a graph showing the same relationship as above, as determined by Examples 7 to 10.

Molten aluminum 1 was treated under the same conditions and in the same manner as in Example 1 except that before the introduction of Ar gas into the melt 1, a mixture of 90 g of $Na_2B_4O_7$, 115.5 g of KCl and 94.5 g of NaCl was sprinkled over the surface of the melt in an amount of $9.86\times10^{-3}$ g/cm$^2$ calculated as boron to determine the the relation between the treating time and the hydrogen gas content of the resulting melt. FIG. 5 shows the result.

EXAMPLE 8

Molten aluminum 1 was treated under the same conditions and in the same manner as in Example 1 except that before the introduction of Ar gas into the melt 1, a mixture of 73 g of $Na_2B_4O_7$, 124.8 g of KCl and 102.2 g of NaCl was sprinkled over the surface of the melt in an amount of $8.0\times10^{-3}$ g/cm$^2$ calculated as boron to determine the relation between the treating time and the hydrogen gas content of the resulting melt. FIG. 5 shows the result.

EXAMPLE 9

Molten aluminum 1 was treated under the same conditions and in the same manner as in Example 1 except that before the introduction of Ar gas into the melt 1, a mixture of 55 g of $Na_2B_4O_7$, 134.7 g of KCl and 110.3 g of NaCl was sprinkled over the surface of the melt in an amount of $6.0\times10^{-3}$ g/cm$^2$ calculated as boron to determine the relation between the treating time and the hydrogen gas content of the resulting melt. FIG. 5 shows the result.

EXAMPLE 10

Molten aluminum 1 was treated under the same conditions and in the same manner as in Example 1 except that before the introduction of Ar gas into the melt 1, a mixture of 11.7 g of $Na_2B_4O_7$, 158.6 g of KCl and 129.7 g of NaCl was sprinkled over the surface of the melt in an amount of $1.28\times10^{-3}$ g/cm$^2$ calculated as boron to determine the relation between the treating time and the hydrogen gas content of the resulting melt. FIG. 5 shows the result.

EXAMPLE 11

Figure 6:
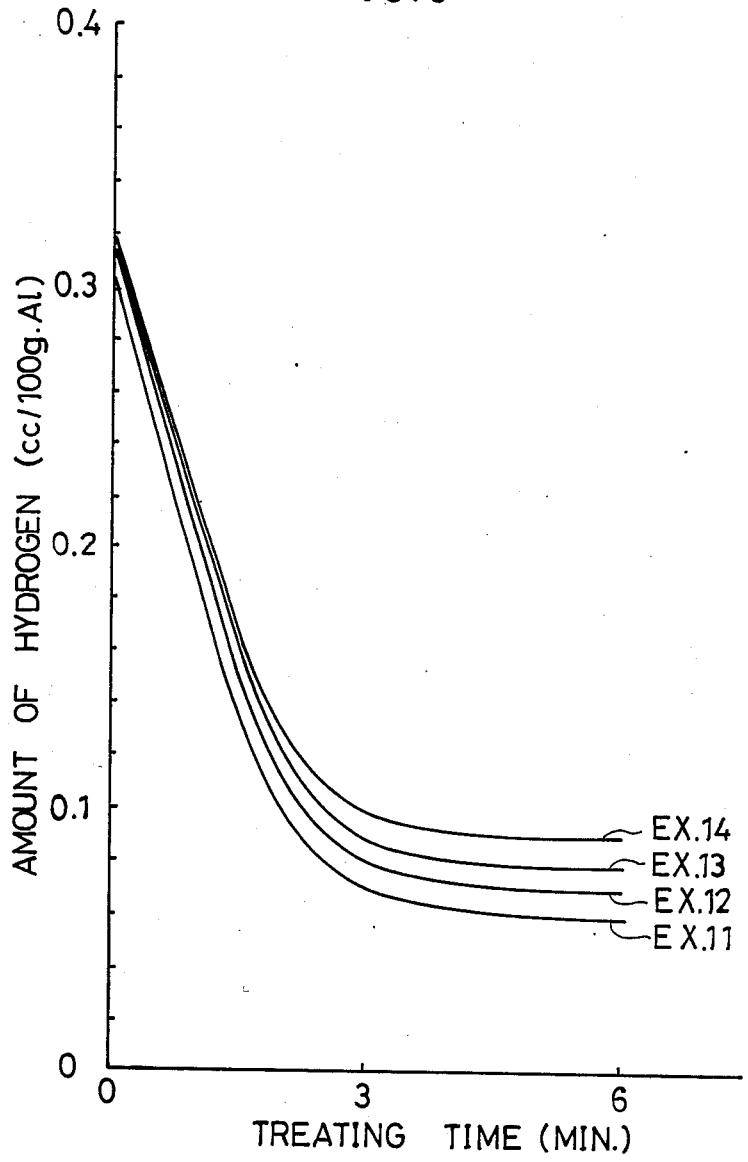
FIG. 6 is a graph showing the same relationship as above, as determined by Examples 11 to 14.

Molten aluminum 1 was treated under the same conditions and in the same manner as in Example 1 except that before the introduction of Ar gas into the melt 1, a mixture of 110 g of $H_3BO_3$, 82.3 g of KCl, 88.5 g of NaCl and 19.2 g of $Na_3AlF_6$ was sprinkled over the surface of the melt in an amount of $9.81\times10^{-3}$ g/cm$^2$ calculated as boron to determine the relation between the treating time and the hydrogen gas content of the resulting melt. FIG. 6 shows the result.

EXAMPLE 12

Molten aluminum 1 was treated under the same conditions and in the same manner as in Example 1 except that before the introduction of Ar gas into the melt 1, a mixture of 95 g of $H_3BO_3$, 88.8 g of KCl, 95.5 g of NaCl and 20.7 g of $Na_3AlF_6$ was sprinkled over the surface of the melt in an amount of $8.47\times10^{-3}$ g/cm$^2$ calculated as boron to determine the relation between the treating time and the hydrogen gas content of the resulting melt. FIG. 6 shows the result.

EXAMPLE 13

Molten aluminum 1 was treated under the same conditions and in the same manner as in Example 1 except that before the introduction of Ar gas into the melt 1, a mixture of 68 g of $H_3BO_3$, 100.5 g of KCl, 108.1 g of NaCl and 23.4 g of $Na_3AlF_6$ was sprinkled over the surface of the melt in an amount of $6.06\times10^{-3}$ g/cm$^2$ calculated as boron to determine the relation between the treating time and the hydrogen gas content of the resulting melt. FIG. 6 shows the result.

EXAMPLE 14

Molten aluminum 1 was treated under the same conditions and in the same manner as in Example 1 except that before the introduction of Ar gas into the melt 1, a mixture of 14.4 g of $H_3BO_3$, 123.6 g of KCl, 133 g of NaCl and 29 g of $Na_3AlF_6$ was sprinkled over the surface of the melt in an amount of $1.28\times10^{-3}$ g/cm$^2$ calculated as boron to determine the relation between the treating time and the hydrogen gas content of the resulting melt. FIG. 6 shows the result.

EXAMPLE 15

Figure 7:
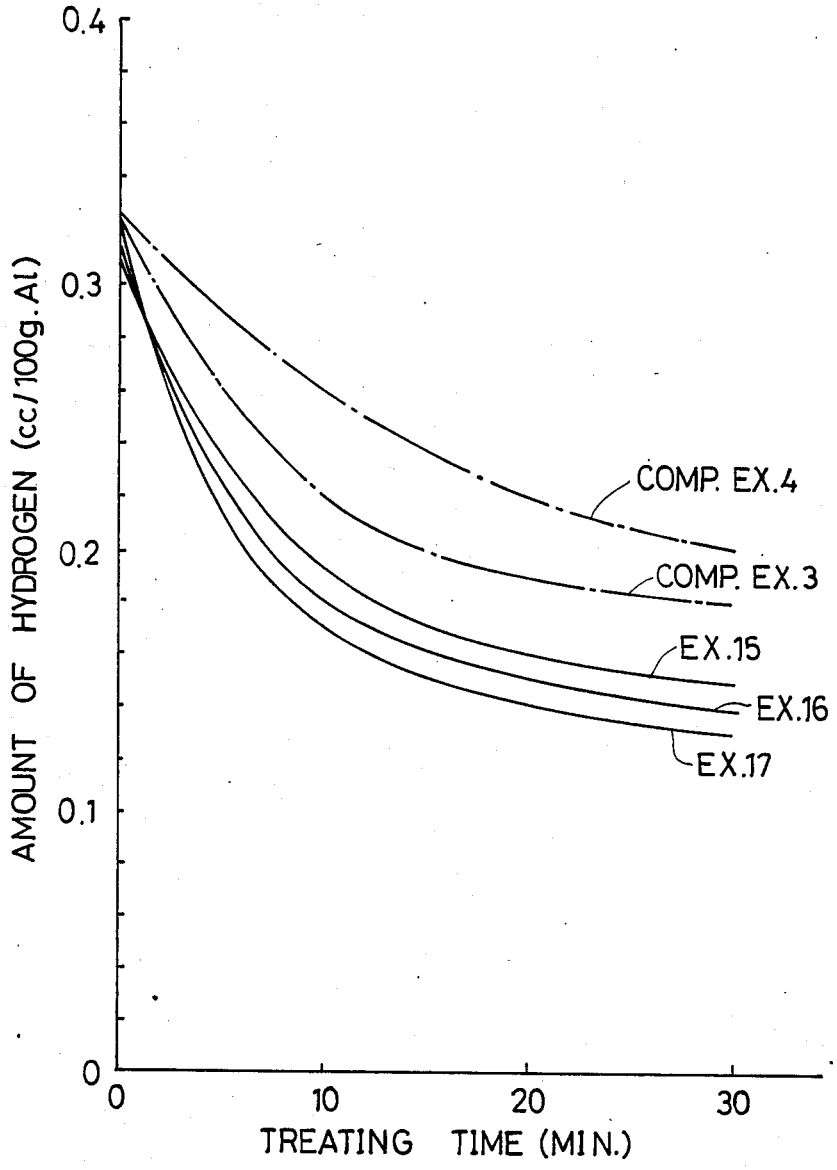
FIG. 7 is a graph showing the same relationship as above, as determined by Examples 15 to 17 and Comparative Examples 3 and 4.

The apparatus shown in FIG. 3 was used. Molten Al200 (300 kg) was placed into the treating container 2, 500 mm in inside diameter, and maintained at 700° C. The surface area of the melt 1 within the container 2 and the water content of the atmosphere above the melt 1 were the same as those in Example 1. A mixture of 90 g of $Na_2B_4O_7$, 94.5 g of NaCl and 115.5 g of KCl was sprinkled over the surface of the molten aluminum. The amount of boron applied to the surface of the melt 1 was $9.86\times10^{-3}$ g/cm$^2$. Ar gas was thereafter introduced into the melt 1 at a rate of 30 liters/min from the gas feeder via the supply pipe 22, the cavity 20 and the porous body 21. The relation between The treating time and the hydrogen gas content of the treated melt was determined in the same manner as in Example 1. FIG. 7 shows the result.

EXAMPLE 16

Molten aluminum 1 was treated under the same conditions and in the same manner as in Example 15 except that before the introduction of Ar gas into the melt 1, a mixture of 60 g of $B_2O_3$, 151.2 g of KCl and 88.8 g of KF was sprinkled over the surface of the melt in an amount of $9.49\times10^{-3}$ g/cm$^2$ calculated as boron to determine the relation between the treating time and the hydrogen gas content of the resulting melt. FIG. 7 shows the result.

EXAMPLE 17

Molten aluminum 1 was treated under the same conditions and in the same manner as in Example 15 except that before the introduction of Ar gas into the melt 1, a mixture of 110 g of $H_3BO_3$, 82.3 g of KCl, 88.5 g of NaCl and 19.2 g of $Na_3AlF_6$ was sprinkled over the surface of the melt in an amount of $9.8\times10^{-3}$ g/cm$^2$ calculated as boron to determine the relation between the treating time and the hydrogen gas content of the resulting melt. FIG. 7 shows the result.

COMPARATIVE EXAMPLE 1

The same treatment as in Example 1 was conducted except that a mixture of 189 g of KCl and 111 g of KF was sprinkled over the surface of the melt 1 within the container 2. FIG. 4 shows the result.

COMPARATIVE EXAMPLE 2

The same treatment as in Example 1 was conducted with the exception of applying nothing to the surface of the melt 1 in the container 2. FIG. 4 shows the result.

COMPARATIVE EXAMPLE 3

The same treatment as in Example 15 was conducted except that the mixture applied to the surface of the melt 1 in the container was composed of 135 g of NaCl and 165 g of KCl. FIG. 7 shows the result.

COMPARATIVE EXAMPLE 4

The same treatment as in Example 15 was conducted with the exception of applying nothing to the surface of the melt 1 in the container 2. FIG. 7 shows the result.

COMPARATIVE EXAMPLE 5

The same treatment as in Example 1 was conducted with the exception of applying nothing to the surface of the melt 1, introducing $N_2$ gas at a rate of 20 liters/min into the interior space of the container 2 above the melt 1 to give a pressure load of 5 mm Hg to the space and reducing the water content of the atmosphere in this space to 1 mg/liter. FIG. 4 shows the result.

The results of Examples 1 to 17 and Comparative Examples 1 to 5 reveal, for example, the following:

(a) The application of a mixture of at least one compound selected from the group consisting of boron oxides, boric acids and boric acid compounds and a flux comprising a halogen salt to the surface of the molten aluminum in the container achieves a higher hydrogen gas removal efficiency than otherwise. The removal efficiency increases with an increase in the amount of boron applied to the surface of the melt (see Examples 1 to 17 and Comparative Examples 1 to 4).

(b) A higher hydrogen gas removal efficiency can be achieved when the treatment is conducted with the mixture applied to the surface of the melt in the container than when an inert gas is introduced into the atmosphere above the melt surface to reduce the water content of the atmosphere instead of applying the mixture (see Examples 1 to 17 and comparative Example 5).

What is claimed is:

1. A method of treating molten aluminum in an atmosphere containing water therein, by removing hydrogen gas and nonmetallic inclusions therefrom comprising applying over the surface of molten aluminum in a treating container a mixture of at least one compound selected from the group consisting of boron oxides, boric acids and boric acid compounds and a flux comprising a halogen salt, whereby aluminum is prevented from reacting with the water in the atmosphere above the aluminum melt surface in the treating container; introducing a treating gas into the molten aluminum; and removing the hydrogen gas-containing treating gas and nonmetallic inclusions rising to the surface of the molten aluminum.

2. A method as defined in claim 1 wherein said at least one compound selected from the group consisting of boron oxides, boric acids and boric acid compounds is applied to the surface of the molten aluminum in an amount of at least $1.28\times10^{-3}$ g/cm$^2$ in terms of the amount of boron.

3. A method as defined in claim 1 wherein said at least one compound selected from the group consisting of boron oxides, boric acids and boric acid compounds is applied to the surface of the molten aluminum in an amount of at least $8\times10^{-3}$ g/cm$^2$ in terms of the amount of boron.

4. A method as defined in claim 1 which is practiced with use of a treating gas introduction device comprising a rotary shaft extending into the molten aluminum and having a treating gas supply channel in its interior, and a rotor fixed to the lower end of the shaft and having a treating gas discharge outlet in communication with the gas supply channel and in which the treating gas is introduced into the molten aluminum from the discharge outlet by rotating the rotor while feeding the treating gas into the supply channel.

5. A method as defined in claim 1 wherein the treating container has a cavity in the inner surface of its bottom wall, a porous body fitted in the cavity for releasing the treating gas in the form of bubbles and a treating gas supply pipe provided in the bottom wall and open at its one end within the cavity and at the other end outside the container, and the treating gas is introduced into the molten aluminum by being passed through the porous body and released into the molten aluminum in the form of a multiplicity of minute bubbles.

* * * * *